US008273224B2

(12) United States Patent
Bayer et al.

(10) Patent No.: US 8,273,224 B2
(45) Date of Patent: Sep. 25, 2012

(54) COMPOSITE COLLECTOR BAR

(75) Inventors: Ingo Bayer, Richards Bay (ZA); Bruce Ringsby Olmstead, Pretoria (ZA)

(73) Assignee: BHP Billiton Innovation Pty Ltd, Melbourne (AU)

( * ) Notice: Subject to any disclaimer, the term of this patent is extended or adjusted under 35 U.S.C. 154(b) by 204 days.

(21) Appl. No.: 12/740,591

(22) PCT Filed: Oct. 29, 2008

(86) PCT No.: PCT/AU2008/001594

§ 371 (c)(1),
(2), (4) Date: Apr. 29, 2010

(87) PCT Pub. No.: WO2009/055844

PCT Pub. Date: May 7, 2009

(65) Prior Publication Data

US 2010/0258434 A1 Oct. 14, 2010

(30) Foreign Application Priority Data

Oct. 29, 2007 (AU) ..... 2007905939

(51) Int. Cl.
*C25C 3/08* (2006.01)
*C25C 3/16* (2006.01)

(52) U.S. Cl. ..... 204/247.4; 204/247.5; 204/243.1; 204/244; 204/247.1

(58) Field of Classification Search ..... 204/243.1, 204/244, 247.1, 247.4, 247.5
See application file for complete search history.

(56) References Cited

U.S. PATENT DOCUMENTS

| | | | | |
|---|---|---|---|---|
| 2,846,388 | A | 8/1958 | Morel | |
| 4,795,540 | A | 1/1989 | Townsend | |
| 6,231,745 | B1 * | 5/2001 | Homley et al. | 205/374 |
| 6,387,237 | B1 * | 5/2002 | Homley et al. | 205/372 |
| 2004/0247998 | A1 * | 12/2004 | Nakanishi et al. | 429/161 |
| 2005/0218006 | A1 | 10/2005 | Bonnafous et al. | |
| 2008/0135417 | A1 * | 6/2008 | Allano et al. | 205/560 |

FOREIGN PATENT DOCUMENTS

| | | |
|---|---|---|
| EP | 1845174 | 10/2007 |
| EP | 1 927 679 A1 | 6/2008 |
| FR | 1 161 632 | 9/1958 |
| FR | 2 868 435 A1 | 10/2005 |
| WO | WO 01/27353 | 4/2001 |
| WO | WO 01/63014 | 8/2001 |
| WO | WO 03/014423 | 2/2003 |

OTHER PUBLICATIONS

BHP Billiton Innovation Pty Ltd., European Search Report from corresponding EP Application No. 08843414.7 dated Dec. 14, 2010.

* cited by examiner

*Primary Examiner* — Bruce Bell
(74) *Attorney, Agent, or Firm* — Margaret B. Brivanlou; King & Spalding

(57) ABSTRACT

A collector bar for electrical connection to a busbar system of an electrolytic cell, the collector bar being received within a recess in a cathode block of the cathode of the electrolytic cell; wherein the collector bar comprises a first conductor which electrically connects to the busbar system, the first conductor having an external surface or surfaces which electrically contact the cathode block and at least one second conductor having a lower electrical resistance to the first conductor, the second conductor being positioned on at least one external surface of the first conductor in electrical contact with the first conductor.

8 Claims, 3 Drawing Sheets

COMPOSITE COLLECTOR BAR

FIELD OF THE INVENTION

The present invention relates to the electrolytic reduction cells used for the production of aluminium and in particular the collector bars forming part thereof.

BACKGROUND OF THE INVENTION

Aluminium metal is generally extracted from alumina ($Al_2O_3$) electrolytically by a method commonly referred to as the Hall Héroult process. This process is well known to practitioners in the aluminium industry, and needs no further discussion here.

Rather than directing attention to the process itself, the focus of this invention lies on the vessel or cell in which this electrolytic process is operated. The upper (anodic) portion of the cell is typically comprised of one or more current carrying (commonly carbonaceous) blocks intended to evenly distribute electrical current across a shallow (in the sense that it is of much greater dimension horizontally than vertically through its depth) liquid layer of molten cryolite, surmounting another layer of molten aluminium.

The lower (cathodic) portion of the cell physically contains the layers of molten cryolite and aluminium in a cavity formed of refractory materials, with the lower surface of that cavity again formed of electrically-conducting (commonly carbonaceous) material. That electrically-conducting material is commonly formed as a series of large blocks (cathode blocks), into which metallic current conductors (collector bars) are embedded to provide an assembly of paths for the electrical current to leave the cell.

It is common practice that a plurality of these cells are connected together as a series circuit by a system of busbars, enabling the electrical current to enter each cell in turn through its anodic portion, provide energy for the electrolytic process operated within the liquid cryolite and aluminium layers contained within the cathodic portion, and ultimately leave the cell through the collector bars.

As the electrical current traverses the cell, it naturally seeks the path of least resistance through the cell components, thereby directing the greatest concentration of the current towards the juncture at which the collector bars leave the cathode blocks. This uneven distribution of current has the deleterious effect of significantly increasing the consumption (generally by means of erosive processes) of the cathode blocks in the areas of highest current concentration.

Prior art demonstrates that the distribution of current across the cathode blocks can be significantly improved by use of a composite collector bar, consisting of an outer steel sheath enclosing a highly electrically-conductive (typically copper) core for part of its length. This improvement in current distribution is known to significantly improve the operational lives of the cathode blocks.

While these improved collector bars contribute towards lower cathode erosion and hence improve the operational lives of the cathode blocks, these benefits need to be weighed against the high fabrication costs related to the materials of construction and the complexity of assembly of the composite collector bar arrangements. Therefore, a need exists for a composite collector bar arrangement having the benefits of the complementary material arrangements, but which is relatively simpler to fabricate, thereby significantly reducing costs.

SUMMARY OF THE INVENTION

In the one aspect of the present invention, there is provided an electrolytic cell in a series of cells for the production of aluminium comprising of:

- a shell and a refractory arrangement forming the working cavity for the containment of high temperature liquids;
- an electrically-conducting cathode comprising a plurality of cathode blocks forming the base of the working cavity;
- at least one anode suspended within the cell and in contact with the high temperature liquids in the working cavity;
- at least one collector bar received within recesses formed in each cathode block of the cathode, the collector bar being positioned in the cathode block to not directly contact the liquids in the working cavity;
- an electrical busbar system located externally of the shell for transferring electrical current from the collector bars of the cell to the anode of the next cell in the series of cells;
- wherein the collector bar comprises a first conductor and at least one second conductor, the first conductor electrically connecting to the electrical busbar system, and having an external surface or surfaces which electrically connect to the cathode block, the at least one second conductor having an electrical resistance less than the first conductor, the second conductor being positioned on at least one external surface of the first conductor in electrical contact with the first conductor.

According to a second aspect, the invention provides,

- a collector bar for electrical connection to a busbar system of an electrolytical cell, the collector bar being received within a recess in a cathode block of a cathode of the electrolytic cell wherein
- the collector bar comprises a first conductor which electrically connects to the busbar system, the first conductor having an external surface or surfaces which electrically contact the cathode block and at least one second conductor having a lower electrical resistance to the first conductor, the second conductor being positioned on at least one external surface of the first conductor in electrical contact with the first conductor.

The composite collector bar of the invention may have the second conductor either mechanically or chemically bonded to the first conductor. In a preferred form of the invention, this first conductor, which is preferably greater in cross-section area than the second conductor, forms the lower external surface of the composite collector bar when it is fixed into the cathode block.

The first conductor of the composite collector bar is preferably produced from material which is of relatively low thermal and electrical conductivity, such as steel. The low thermal conductivity reduces heat loss through the ends of the collector bar, and particularly to the external current carrier arrangement.

In contrast to the first conductor, the second conductor of the composite collector bar is preferably produced from a material of relatively high thermal and electrical conductivity, such as copper. Thus the second conductor is of higher thermal and/or electrical conductivity compared to the first conductor. The higher electrical conductivity of the second conductor provides an approximately uniform electrical potential through the collector bar, thereby promoting a uniform current density at the surface of the cathode block. Additionally, the higher electrical conductivity of the second conductor provides a path of lower resistance between the cathode blocks and the external current carrier, thereby reducing the voltage drop through the cathode block assembly.

Alternatively, the first conductor of the composite collector bar may be channel-shaped, or have a recess formed therein, with the second conductor bonded into the recess. In this instance, the collector bar may be fixed into the cathode block either with the first conductor located uppermost (in which case all sides of the composite are protected chemically from the cathode) or with the second conductor uppermost (in which case an additional insulation layer may be placed between the external surfaces of the second conductor and the cathode block).

Although other cross-sections (e.g. circular cross-sections) are possible, the cross-sectional shapes of the two conductors of the composite collector bar will generally be polygonal, and most commonly will be either rectangular or channel shaped. In any instance, the second (highly conductive) conductor will form at least part of one external surface of the collector bar. The two conductors of the collector bar will be securely bonded to each other to ensure good electrical contact.

The relative cross-sectional areas of the first and second conductors of the composite collector bar are designed to optimize electrical currents and heat flux through the composite. Although the ratio of the areas of the first and second conductors of the collector bar are dependent upon details of the cathode and refractories design, for reasons of cost, the cross-sectional area of the second (highly conductive) conductor of the composite will preferably comprise less than 50% of the total collector bar cross-section. Mathematical modelling may be used to optimally position the two conductors of the composite collector bar against the cathode block to minimise heat loss and optimise the electrical current distribution across the outer face of the cathode block.

As a further elaboration of this invention, the relative cross-sectional areas of the first and second conductors of the collector bar can be varied in subsequent cathode blocks in the cathode along the length of the electrolytic cell. Variation in the relative cross-sectional areas of the collector bar conductors between subsequent cathode block assemblies may be used to beneficially alter the distribution of the current density field and total current flow through the cell.

Bonding techniques which may be used to fabricate the composite collector bar are well-known prior art and include (but are not limited to) interference fits, interlocking attachments, riveting, explosion bonding or roll bonding. Prior art also teaches that suitable such bonds may be facilitated by the introduction of an intermediate layer between the two conductors of the composite to assist either chemically or mechanically with the bond strength. Should such an intermediate bonding layer be employed, it should not adversely affect the electrical contact between the two conductors of the composite collector bar.

DETAILED DESCRIPTION OF THE EMBODIMENTS

A preferred embodiment of the invention will now be described with reference to the above drawings.

Figure 1:
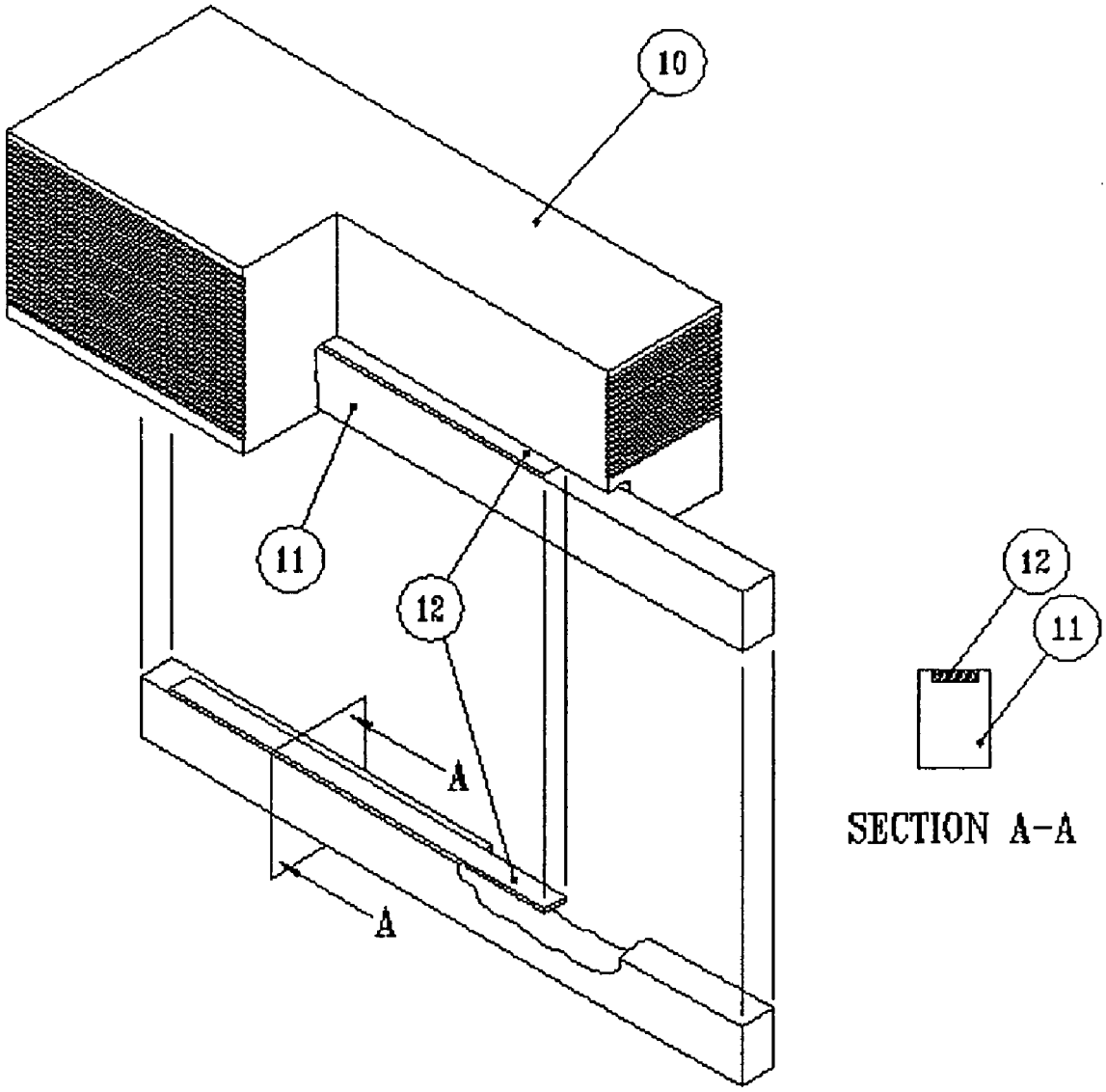
FIG. 1 presents one embodiment of the collector bar of the invention in a cathode block.

Referring to FIG. 1, a collector bar according to an embodiment of the invention is shown. A cathode block 10 is shown having a collector bar fitted within a recess formed in the cathode block 10. The collector bar includes a first conductor 11 which is typically a steel body and a second conductor 12 which is typically formed from a highly conductive metal such as copper fitted into a recess within the first conductor 11. In this embodiment of the invention that portion of the collector bar which houses the conductive insert is located entirely within the cathode block. Cross section A-A (FIG. 1) of the collector bar shows that the second conductor 12 is much thinner than the first conductor 11. The second conductor 12 is located within the upper external surface of first conductor 11 such that the external surface incorporating the second conductor is exposed to the cathode. Consistent with the use of the collector bar, the length direction of both the first and second conductors are greater than the height or width dimensions of both the first and second conductors giving the first and second conductors an elongate shape. Hence the elongated collector bar fits within an elongated channel formed within the cathode block.

Figure 3:
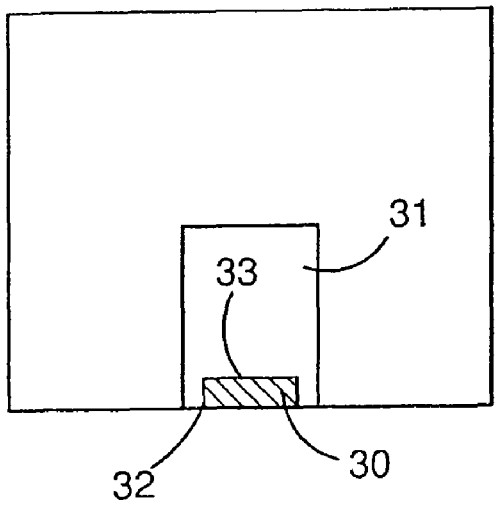
FIG. 3 is a cross sectional view of a second embodiment of a collector bar in a cathode block.

In another preferred embodiment of the invention, (FIG. 3) the second conductor 30 is mechanically or chemically bonded into the first conductor 31. In this second embodiment, the first conductor which would generally have a greater cross sectional area to the second conductor, forms the lower surface of the collector bar when it is fitted into the cathode block. In this embodiment, the second conductor is fitted within a recess 32 formed in the external surface 33 of the first conductor and is not bordered by the cathode block when installed. In this embodiment the second conductor is not exposed or in direct contact with the cathode block and would be expected to be durable under normal working conditions.

Figure 4:
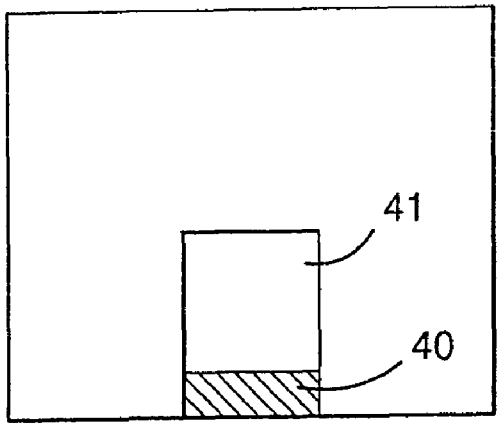
FIG. 4 is a cross sectional view of a third embodiment of a collector bar in a cathode block.

In a further embodiment of the invention (FIG. 4), the second conductor 40 is mechanically or chemically bonded to one external surface of the first conductor 41. The second conductor 40 would have the same length and width dimensions as the first conductor 41, thereby completely covering one side of the first conductor. This embodiment could be used with the second conductor comprising the lower most external surface of the collector bar.

However when this embodiment of the invention is used in a cathode block it is preferable that the highly conductive second conductor 40 is the lower most surface of the collector bar so that only the minor side regions of the second conductor are exposed to the cathode block.

In all embodiments, generally the second conductor occupies less than 50% of the total collector bar cross sectional area.

Bonding techniques which may be used to fabricate the composite collector bar according to the invention are well known in the art and include (but are not limited to) interference fits, interlocking attachments, riveting, explosion bonding or roll bonding. Those skilled in the art would appreciate that such bonds may be facilitated by the introduction of an intermediate layer between the two conductors of the composite bar to assist either chemically or mechanically with the bond strength between the two conductors. Should such an intermediate bonding layer be employed, such a layer should not adversely affect the electrical contact between the two conductors of the composite collector bar. ie. it is a requirement of the invention that good electrical conductivity is established and maintained between the first and second conductors of the collector bar.

Figure 2:
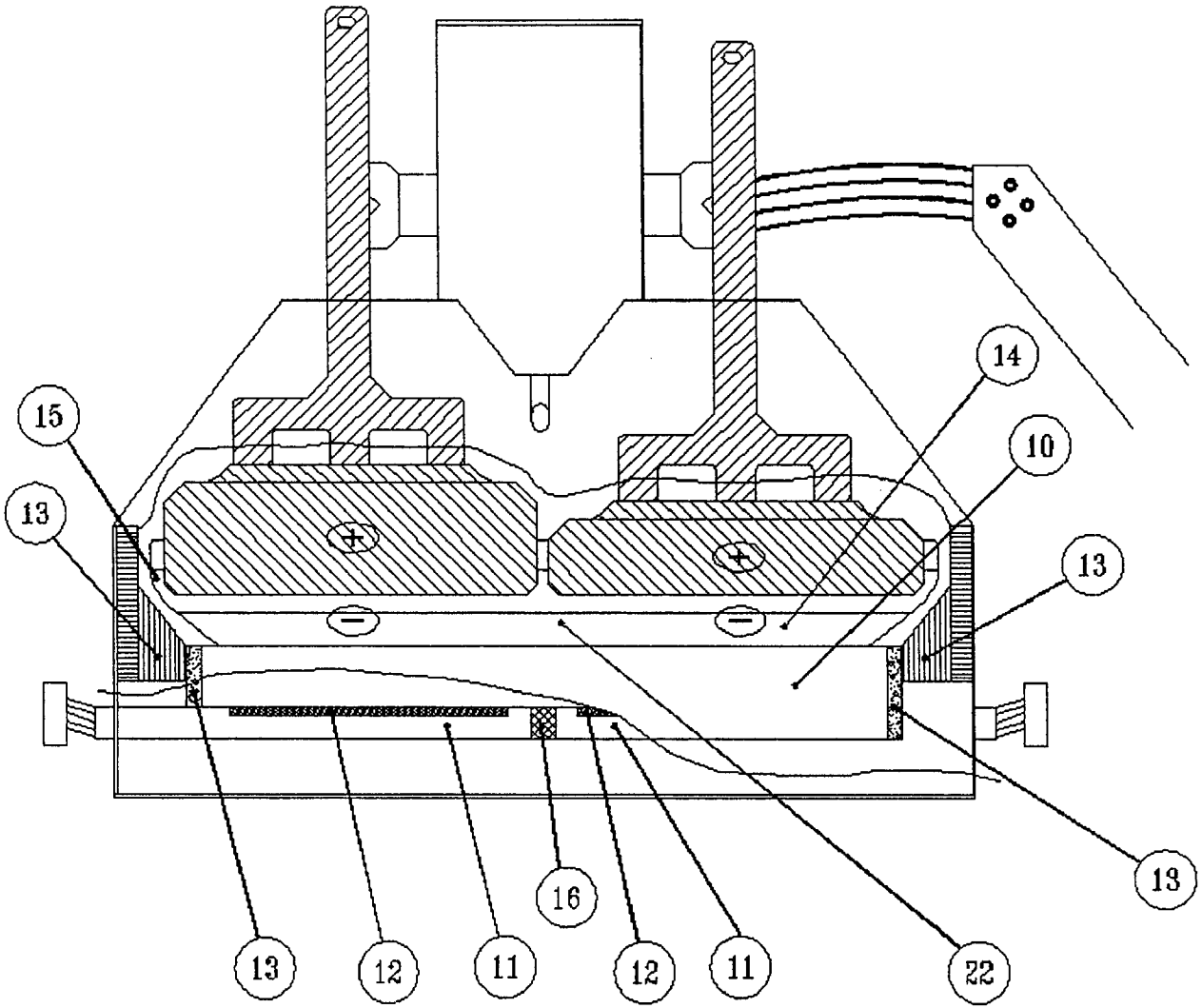
FIG. 2 presents a cross-sectional view of an electrolytic cell containing a collector bar of the invention.

FIG. 2 is a cross sectional view of an electrolytic cell containing the collector bar according to the embodiment shown in FIG. 1. The electrolytic cell is typically one of a series of cells in a pot line for the production of aluminium by the Hall-Héroult process. The electrolytic cell comprises a shell and refractory arrangement forming the working cavity for the containment of high temperature liquids. In the production of aluminium these liquids are molten liquid cryolite and molten aluminium. The cell comprises a cathode comprising a plurality of cathode blocks which form the base of the working cavity. Each of the cathode blocks extends transversely across the electrolytic cells. The cathode blocks forming the cathode are surrounded at their ends and below by refractory bricks and filler material 13. During use the cathode is surmounted by molten aluminium 14 and molten cryolite 15. Within the electrolytic cell according to the invention the second conductors 12 are shown bonded within the first conductors of the collector bar 11. Although the conductive inserts 12 are shown as being located fully within the cathode block 10, in other embodiments of the invention these inserts may occupy the entire length of one of the surfaces of the collector bar. As shown in FIG. 2, it is common practice that more than one collector bar may be wed through the length of the cathode block, in which case the collector bars are separated at their internal ends by insulating material 16.

In mathematical models processed for collector bars made from a single material such as steel, the electrical potential is high across a substantial proportion of the cathode block and reduces non-uniformly towards the connections of the collector bar to the busbar system. In such instance, differences in potential across the upper surface of the cathode block are approximately 100-150 mV. Mathematical models processed for such a collector bar configuration as presented in FIG. 2 reveals that while the potential is initially high along the upper most surface of the cathode block the potential reduces almost uniformally across the height of the cathode blocks. Differences in potential across the upper surface of the cathode block are much less than 10 mV. This is an indication that the composite collector bar effectively provides an equipotential surface within the cathode block, thereby ensuring a current distribution is much more uniform across the cathode block when using a collector bar consistent with the invention, thereby providing more even wear across the cathode block.

As used herein, the term "comprise" and variations of the term, such as "comprising", "comprises" and "comprised", are not intended to exclude other additives, components, integers or steps.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. An electrolytic cell in a series of electrolytic cells for the production of aluminum comprising:

a shell and a refractory arrangement forming a working cavity for containment of high temperature liquids;

an electrically-conducting cathode comprising a plurality of cathode blocks forming a base of the working cavity;

an electrical current busbar system located externally of the shell; and at least one anode suspended within the electrolytic cell and in contact with the high temperature liquids in the working cavity;

at least one collector bar received within a recess in at least one cathode block of the cathode, the at least one collector bar being positioned in the cathode block to not directly contact the liquids in the working cavity, the collector bar comprising a first conductor which electrically connects to the busbar system, the first conductor having an external surface or surfaces which electrically contacts the cathode block and at least one second conductor having a lower electrical resistance to the first conductor, wherein the second conductor is mechanically or chemically bonded to the external surface of the first conductor or into a recess formed in an external surface of the conductor to establish and maintain electrical connectivity with the first conductor, wherein the mechanically or chemically bonded second conductor forms at least one part of an one external surface of the first conductor; and the electrical current busbar system transfers electrical current from the at least one collector bar of the electrolytic cell to the at least one anode of a next electrolytic cell in the series of electrolytic cells.

2. The electrolytic cell of claim 1 wherein the second conductor of the collector bar is within a section of the first conductor entirely within the cathode block.

3. The electrolytic cell of claim 1 wherein the cross sectional area of the first conductor of the collector bar is greater than the cross sectional area of the second conductor.

4. The electrolytic cell of claim 1 wherein the cross sectional area of the second conductor of the collector bar is less than 50% of the total collector bar.

5. The electrolytic cell of claim 1 wherein the second conductor of the collector bar is positioned along a longitudinal external surface of the first conductor.

6. The electrolytic cell of claim 4 wherein the first conductor of the collector bar forms the lower external surface of the composite collector bar.

7. The electrolytic cell of claim 1 wherein the second conductor of the collector bar is of higher electrical conductivity than the first conductor.

8. The electrolytic cell of claim 1 wherein the first conductor of the collector bar is channel shaped or is provided with a recess in its external surface and the second conductor of the collector bar is bonded into the channel or recess.

* * * * *